US005390935A

United States Patent [19]

Wilkins

[11] Patent Number: 5,390,935

[45] Date of Patent: Feb. 21, 1995

[54] PUZZLE CARD GAME

[76] Inventor: Charles A. Wilkins, 30 Hunting Country Trails, Tryon, N.C. 28782

[21] Appl. No.: 62,300

[22] Filed: May 14, 1993

Related U.S. Application Data

[63] Continuation of Ser. No. 803,459, Dec. 6, 1991, abandoned.

[51] Int. Cl.[6] ..... A63F 1/00

[52] U.S. Cl. ..... 273/298; 273/308; 273/296; 273/157 R

[58] Field of Search ..... 273/298, 157 R, 303, 273/302, 306, 308, 276, 243, 248, 256, 296

[56] References Cited

U.S. PATENT DOCUMENTS 2,072,799 3/1937 Creswell ..... 273/308

*Primary Examiner*—Benjamin H. Layno

*Attorney, Agent, or Firm*—Cort Flint

[57] ABSTRACT

An amusement card game is disclosed which includes a playing deck having advancement cards for advancing a player toward a game objective. Impediment cards which impede the advancement of the player, and remedy cards which remove the effect of the impediment card. The game further includes a first stack of instruction cards which are drawn and played in response to reaching levels of advancement in accordance with the advancement cards wherein the instruction cards include good and bad instructions relative to reaching the game objective. Preferably, the instruction cards include intermediate instruction cards which govern reaching intermediate levels of advancement and completion cards which contain good and bad instructions regarding reaching of the final level of advancement and completing the game. In the preferred embodiment, the instruction cards include pictorial designs on one side which fit together to complete a picture when played according to the game. The picture is completed when the prescribed number of advancement cards have been drawn and played.

15 Claims, 4 Drawing Sheets

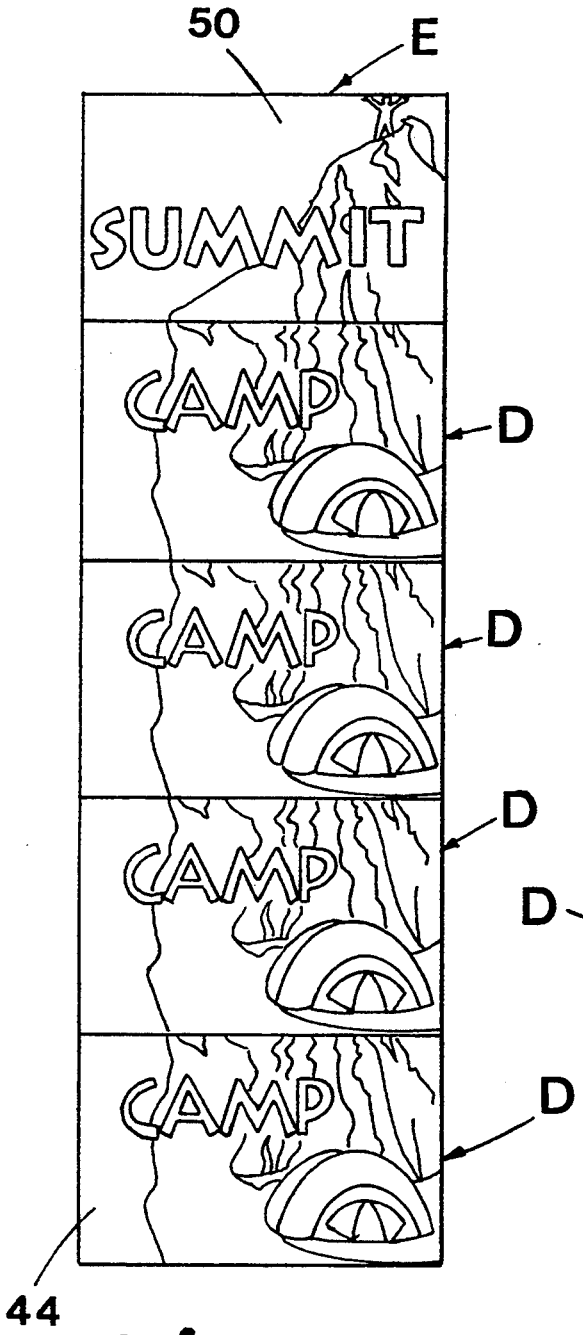
Fig. 1.
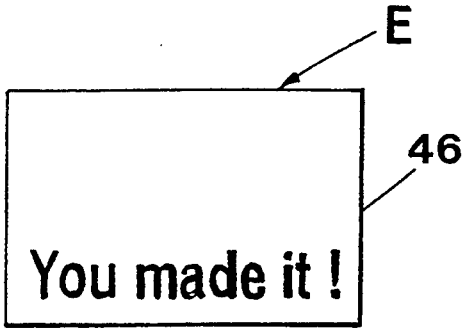
Fig. 2.
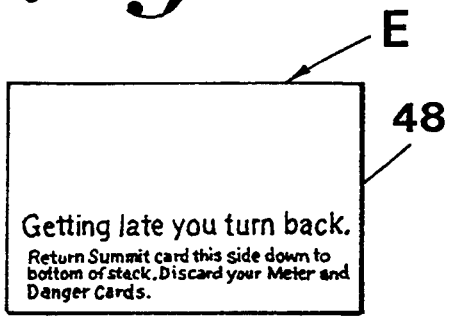
Fig. 2-A.
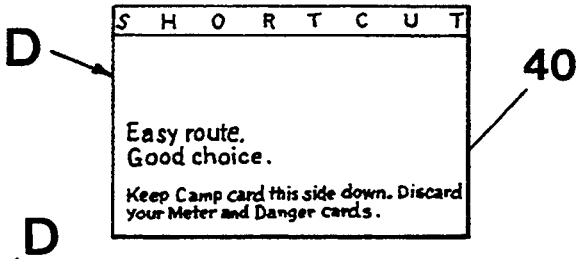
Fig. 3.
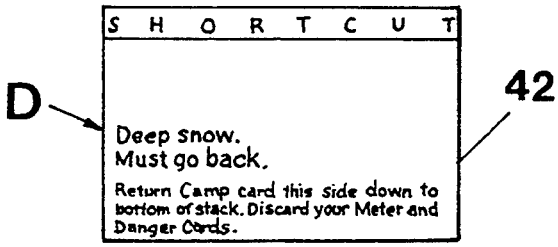
Fig. 3-A.

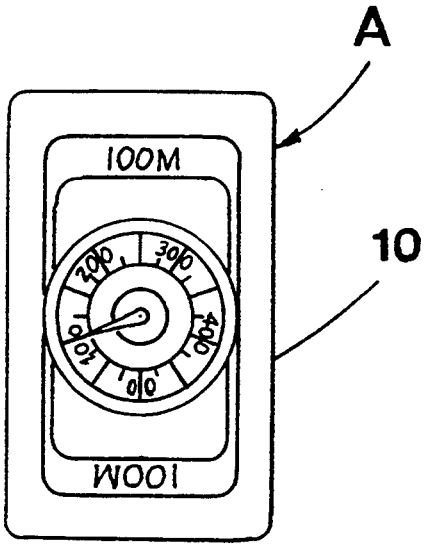
Fig. 4.
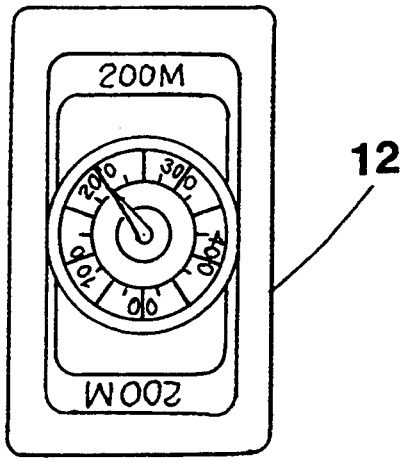
Fig. 4-A.
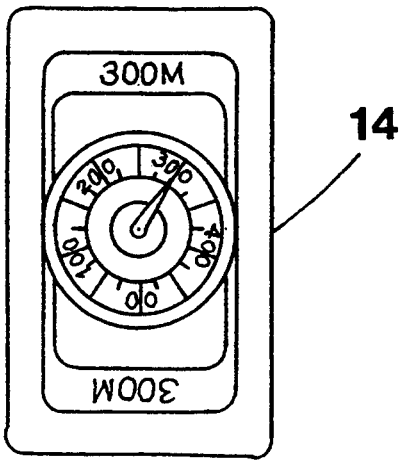
Fig. 4-B.
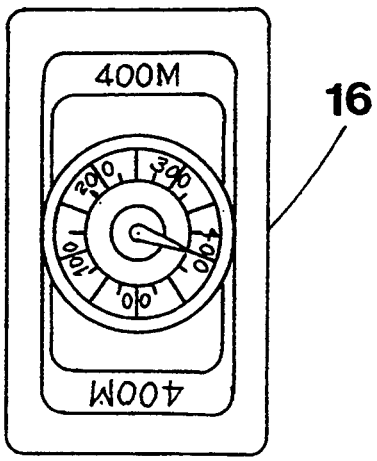
Fig. 4-C.

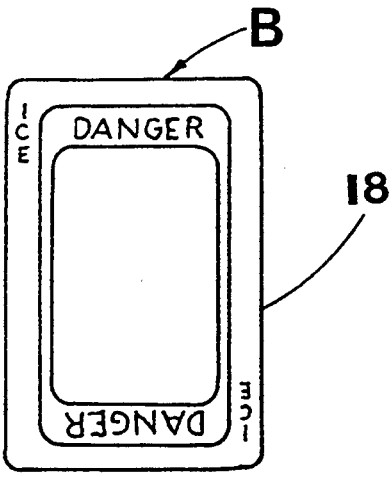
Fig. 5.
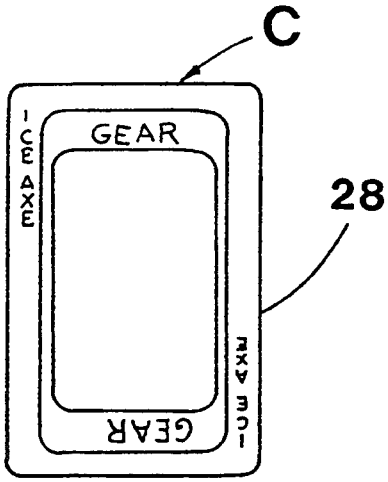
Fig. 5-A.
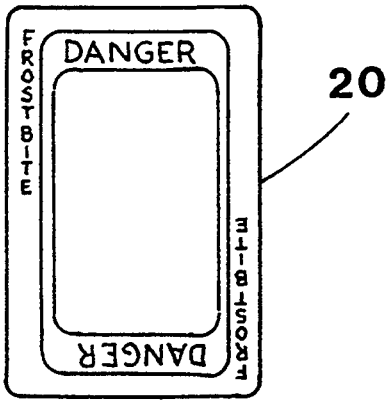
Fig. 6.
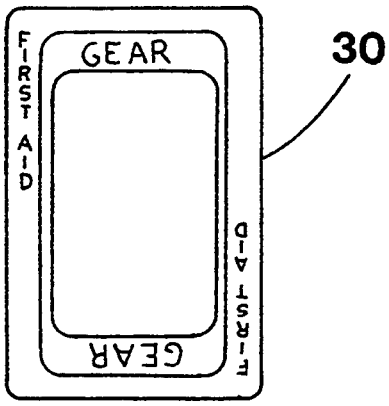
Fig. 6-A.
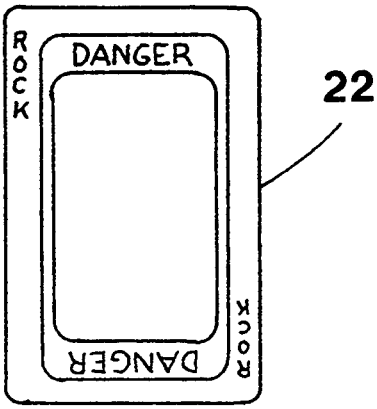
Fig. 7.
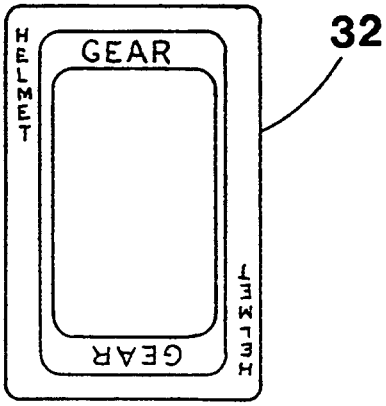
Fig. 7-A.

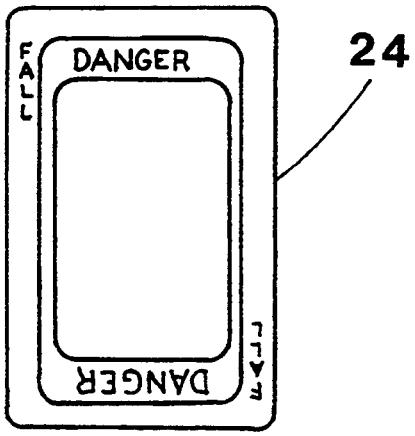
Fig. 8.
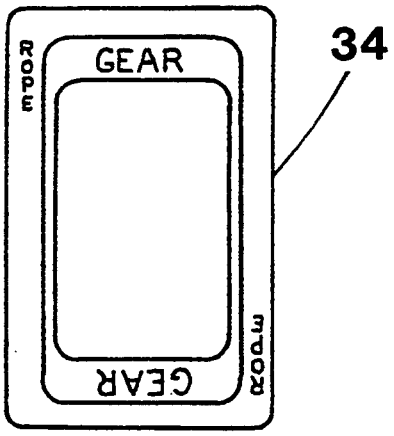
Fig. 8A.
| REFERENCE | |
|---|---|
| DANGER | MATCHING GEAR |
| FALL | ROPE |
| ICE | ICE AXE |
| ROCK | HELMET |
| FROSTBITE LIMIT 200 M. | FIRST AID |
36
Fig. 9.
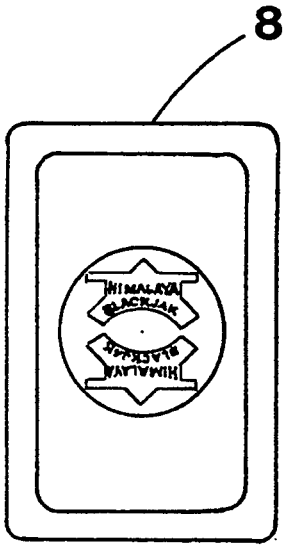
Fig. 10.

PUZZLE CARD GAME

This application is a continuation of U.S. patent application Ser. No. 07/803459, filed on Dec. 6, 1991, and now abandoned.

BACKGROUND OF THE INVENTION

The invention relates to a card game and particularly to a card game having a deck of playing cards and a stack of picture cards have a pictorial section on one side wherein the picture cards are drawn and played in response to drawing and playing the playing cards so that a picture is completed to satisfy the game objective.

In the past, various card games have bean proposed such as disclosed in U.S. Pat. Nos. 4,437,670; 3,734,510; 2,162,428; and 1,410,922. U.S. Pat. No. 2,162,428 discloses a card game which includes a deck of cards having different suits. The cards of the different suits include different sections which fitted together to form a complete design wherein the sections and designs of the different suits have different colors. Tokens are used to purchase different cards to complete the design as the game is played. The remaining three patents, while not including the completion of a design as part of the game objective, disclose various card games and methods of playing the games which are of general interest.

Accordingly, an object of the present invention is to provide an interesting card game which can be played by one player or a plurality of players.

Another object of the present invention is to provide an amusing card game which can be played by one or a plurality of players which includes a playing deck and at least a first stack of cards having a section of a pictorial design on the backside of the cards which are played in response to the playing cards to form a design that must be completed to accomplish the game objective.

Another object of the invention is to provide an amusing card game which includes a first deck of playing cards having indicia of incremental advancement on one side and at least a first stack of cards having a first side with good and bad playing instructions and a second side which includes sections of a pictorial design that must be played and fitted together in order to accomplish the game objective.

Another object of the present invention is to provide an amusing card game for one player or a plurality of players which includes a playing deck having a first plurality of playing cards with indicia of incremental advancement on a first side, and a second plurality of cards which impedes the advancement, if drawn, and a third plurality of cards which removes the effect of the second plurality of cards when drawn.

Still another object of the present invention is to provide an amusing card game for one player or a plurality of players which includes a playing deck having a first plurality of playing cards with indicia of incremental advancement on a first side, and a second plurality of cards which retards the advancement of the first cards if drawn, and a third plurality of cards which removes the effect of the first plurality of cards when drawn. At least a second set of playing cards is provided which includes good and bad instructions on a first side and a section of a pictorial design on a second side wherein the cards from the second deck are played in response to reaching a certain level of advancement from playing the first deck and the sections of pictorial design must be fitted together to make a complete design in order to accomplish the game objective.

SUMMARY OF THE INVENTION

The above objectives are accomplished according to the present invention by providing a card game which includes a playing card deck having advancement cards bearing incremental indicia of advancement. The playing deck further includes impediment cards which prevent the advancement and remedy cards which remedy the impediment cards so that advancement may resume. In addition to the playing deck, there is a plurality of instruction cards having favorable and unfavorable instructions for reaching the game objective. The instruction cards have a backside which includes a section of a pictorial design. The instruction cards are drawn in response to reaching certain levels of advancement and are played according to the instructions on the cards. In order to complete the game objective, instruction cards must be drawn which complete a pictorial design. In addition, there are a second plurality of instruction cards with favorable and unfavorable instructions which must be drawn and played as the last section in the pictorial design.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1 is a top plan view of instruction cards played with pictorial sections fitted together to complete the game objective;

FIGS. 2 and 2A are completion instruction cards illustrating good and bad instructions thereon;

FIGS. 3 and 3A illustrate the back side of the intermediate instruction cards of FIG. 1 illustrating good and bad instructions thereon;

FIGS. 4 through 4C are plan views of playing cards having indicia of incremental advancement on the playing side of the card;

FIGS. 5 through 7 illustrate playing cards in the form of danger or impediment cards which impede the progress and advancement of the player during the game;

FIGS. 5A through 8A illustrate playing cards in the form of remedy or gear cards which remedy and remove the danger card so that normal advancement in the game can proceed when that card is drawn;

FIG. 9 is a reference card illustrating matching danger and gear cards; and

FIG. 10 is a plan view of a deck of the playing cards with their playing sides facing down and of two stacks of instruction cards.

DESCRIPTION OF A PREFERRED EMBODIMENT

Referring now to the drawings, one embodiment of the invention will be described as applied to a mountain climbing game. The playing card deck 8 (FIG. 10) includes advancement cards having indicia of advancement increments in the form of meters. As can best be seen in FIGS. 4 through 4C, the advancement cards are in the form of incremental advancements of 100 meters, 200 meters, 300 meters, and 400 meters. The advancement cards are commonly referred to as meter cards for purposes of illustrating one embodiment of the invention. Also in the deck of playing cards is a second plurality of cards generally referred to as impediment cards B which, at least temporarily, prevent advancement according to the advancement cards A. In the mountain climbing game illustrated, the impediment cards are provided in the form of danger cards illustrated in FIGS. 5 through 8. There is an ice danger card 18, a frost bite danger card 20, a falling rock danger card 22, and a fall danger card 24. There is a third plurality of playing cards C which are remedy cards that match the danger cards and must be played in order to remove the effect of the danger card. For example, the third plurality of playing cards may be commonly referred to as gear cards and may include an ice ax card 28 which remedies and removes the ice danger card 18. There is a first aid gear card 30 which remedies and removes the frost bite danger card 20. There is a gear card 32 in the form of a helmet card which remedies and removes the falling rock danger card 22. Finally, there is a gear card 34 in the form of a rope card which remedies and removes the fall danger card 24. FIG. 9 illustrates a reference card showing the matching danger cards B and gear cards C which remove the danger. As will be explained more fully hereinafter, once a danger card is drawn, the advancement of the player is prevented until a matching gear card is drawn whereupon advancement may be resumed.

In the illustrated embodiment of the invention, there are fifty-eight playing cards in the deck of playing cards. This includes thirty-five meter cards; thirteen 100 meter cards, ten 200 meter cards, seven 300 meter cards, and five 400 meter cards. There are eight danger cards B which includes two fall cards, two frost bite cards, two rock cards, and two ice cards. There are twelve gear cards C which include three rope cards, three first aid cards, three helmet cards, and three ice ax cards. Six reference cards 36 may be provided for playing a game with six or less players.

Referring now to FIGS. 3 and 3A, a stack of cards is illustrated which includes a plurality of instruction cards D which contain and instructions. The cards are generally referred to as short cut instruction cards. Instruction card 40 contains favorable instructions on a first side and instruction card 42 contains unfavorable instructions on a first side. On a second side of each card 40, 42, there is a section 44 of a pictorial design as can best be seen in FIG. 1. In the illustrated embodiment of a mountain climbing game, cards D are camp cards and the pictorial section on side 44 is that of a camp at a certain level reached in the mountain climb. In FIG. 1, there are four camps reached or made during the climb. Preferably, there is a second stack of cards E which includes a second plurality of instruction cards. The second plurality of instruction cards includes cards 46 having good instructions and instruction cards 48 having bad instructions. The second plurality of instruction cards E contains final instructions and in the illustrated embodiment are referred to as summit cards since a second side of the cards includes a section 50 that is the final section of the pictorial design which must be played in order to complete the pictorial design. After four camps are reached, the summit is reached to complete the climb and game. In order to complete the picture, it is necessary to draw a favorable instruction card 46 in order to play the summit card and complete the game. In one embodiment of the invention, seventeen camp cards D are included which includes nine favorable instruction cards 40 and eight unfavorable instruction cards 42. Four summit cards E are provided which includes two cards 46 having good instructions and two cards 48 with bad instructions. The terms picture, and pictorial section, and design used in reference to the backside of the instruction cards D and E means any graphic design or section of a design which fits together to form a completed design such as any form of graphics, geometrics, pictures, etc.

In addition to the cards described above, it may also be desirable to add to the card game three additional cards. The first card is an "avalanche" card. A player drawing the avalanche card must remove all danger and meter cards which he has played and return them to the playing deck. There is a "white out" card which, if drawn by a player, removes all of the danger cards from that player. Finally, there is a "yeti" card. If the yeti card is drawn by a player, the player has the choice of discarding all of his danger cards, taking a meter card from an opponent, or drawing again. That completes the description of the cards used in the card game.

The game may be provided in different forms. The aforedescribed mountain game is particularly advantageous and the method of playing that game will now be described. In setting up the game, the reference cards 36 are removed and each player is give one card. Next, the seventeen camp cards D are mixed and placed in a first stack. Next, the four summit cards E are mixed and placed in a second stack. The main deck of playing cards A, B, and C is then shuffled and placed face down between the players. The top card is turned and placed face up beside the deck to start the discard pile. The player to the left of the shuffler starts the game by drawing the top card either from the deck or off a different card pile. The card is placed face up in front of the player and the turn passes to the left. The next player draws from the deck or off the discard card pile if there is a card and play continues this way throughout the game. The meter cards A are collected to climb the mountain. When a player has exactly one thousand meters, he discards all of the meter cards in any order face up on the discard pile. The player then takes the top camp card from the stack 56 of camp cards D. The pictorial side 44 of the camp card is kept up throughout the game. If a meter card is drawn that causes a player to go over a thousand meters, he is busted and must discard all of his meter cards and does not get a camp card. Whenever a player has five hundred meters or more, before he draws on his next turn, he has a choice of continuing to collect meter cards to reach a level of camp or of taking the top camp card from the stack and following the instructions relating to "short cuts" on the side of the camp card, as can best be seen on camp cards 40, 42. For example, camp card 40 has a favorable instruction "Keep camp card this side down. Discard your meter and danger cards," and camp card 42 has an unfavorable instruction "Return camp card this side down to the bottom of stack. Discard your meter and danger cards." Thus, if a player draws card 40 he gets to keep the card while discarding his meter and danger cards, but if a player draws unfavorable card 42, he does not get to keep the camp card and loses his meter and danger cards and must start over in collecting meter cards in his climb up the mountain. He may retain any camp cards he has played with the pictorial side up at that point. In order to win the game, a player must get four camp cards D and one summit card E, from a stack 58, to form a compete picture, as can best be seen in FIG. 1. To make the picture complete, a player must have reached a camp at four different levels along his climb up the mountain and then reach the summit by drawing a favorable summit card such as 46. Summit cards are also unfavorable as illustrated in card 48 wherein the instruction reads "Return summit card this side down to bottom of stack. Discard your meter and danger cards." In that case, the player does not get to retain the summit card and loses his meter cards up to that level. While the instructions illustrated on the camp and summit cards are illustrated for example purposes only, other favorable and unfavorable instructions may be provided on the cards as desired.

Referring now to gear cards C, when a gear card is drawn, a player may keep it or discard and draw again. A player may keep any three gear cards at a time. If a gear card is drawn, a player can switch it with one he already has and discard it, but cannot draw again. The gear cards are kept whenever a player is busted or reaches camp. When a player draws a danger card D, he must stop collecting meter cards. He keeps the meter cards he already has, but discards any he draws after drawing a danger card. A player cannot Rave more than one danger card at a time. Danger cards cannot be switched but must be discarded after the first one is drawn. The short cut described above cannot be used with the danger card. The frost bite danger card 20 does not stop the player but slows the player. The reference cards 36 show each danger and the matching gear card (e.g. fall and rope). When a player has a danger card and draws or already has a matching gear card, he immediately discards both the gear and danger cards with the gear card on top so that the next player can draw it off of the discard pile. If the frost bite danger card is drawn, a player may continue to play at one hundred and two hundred meter cards. The frost bite card must be discarded when a player is busted or gets a camp card or has the matching gear card. When the avalanche, yeti, and white out cards are drawn, the instructions on the cards are followed. They cannot be drawn off of the discard pile. When the main playing deck has been gone through, the last discard is placed face up to start the new discard pile. The deck is reshuffled and placed face down to continue play.

While a preferred embodiment of the invention has been described using specific terms, such description is for illustrative purposes only, and it is to be understood that changes and variations may be made without departing from the spirit or scope of the following claims.

What is claimed is:

1. A card game consisting of various cards which are drawn and played in various fashions comprising:

a first card deck which includes a plurality of main playing cards which are drawn and played having indicia for incremental advancement of a player toward a game objective;

said main playing cards including a plurality of danger cards which prevent said advancement until a first prescribed condition is satisfied;

said main playing cards including a plurality of matching remedy cards which match said danger cards, and said matching remedy cards said first prescribed condition and remove said danger card to resume said advancement when drawn:

a second card deck Separate from said first card deck which includes a plurality of pictorial cards having pictorial sections on one side of said cards which are drawn and played in response to reaching a prescribed level of said incremental advancement from accumulating said playing cards from said first card deck; and said pictorial sections fit together to form a completed picture in order to accomplish said game objective; and said pictorial sections having a predetermined location in said completed picture corresponding to said prescribed levels from accumulating said playing cards of said first card deck.

2. The game of claim 1 wherein said pictorial cards include a plurality of instruction cards which are drawn and played having instructions which impede and accelerate the advancement of said player according to said playing cards;

said instruction cards include intermediate cards having pictorial sections which fit together in said predetermined locations to partially complete said picture; and said instruction cards include completion cards having final pictorial sections which fit together at a predetermined end location with said intermediate cards to complete said game objective.

3. The game of claim 2 wherein said completion cards include first completion cards having instructions which allow the completion card to be played and the game objective reached and said completion cards include second completion cards having instructions which require that the completion card cannot be played and the game objective cannot be reached.

4. The game of claim 1 wherein said pictorial cards include a plurality of instruction cards which are drawn and played having instructions which impede and accelerate the advancement of said player according to said playing cards;

said instruction cards include intermediate cards having pictorial sections which fit together in said predetermined locations to partially complete said picture; and said instruction cards include completion cards having final pictorial sections which fit together at a predetermined end location with said intermediate cards to complete said game objective.

5. The game of claim 4 wherein said completion cards include first completion cards having instructions which allow the completion card to be played and the game objective reached and said completion cards include second completion cards having instructions which require that the completion card cannot be played and the game objective cannot be reached.

6. A card game consisting of various cards which are drawn and played in various fashion comprising:

a main card deck which includes a plurality of first playing cards which are drawn and played by a player having indicia for incremental advancement of a player toward a game objective;

said main card deck including a plurality of second playing cards drawn by and played by said player which embody stated prescribed conditions which impede and suspend said advancement of said player until said prescribed condition is satisfied; and said main card deck includes a plurality of third playing cards drawn by and played said player which embody stated remedies which match said stated prescribed conditions of said plurality of second playing cards to satisfy said prescribed condition and remove said second playing card so that said player may resume said advancement toward said game objective; and a plurality of pictorial cards which are drawn upon reaching predetermined level of advancements, said pictorial cards fitting together in a prescribed manner in order to reach said game objective.

7. The card game of claim 6 wherein said plurality of first playing cards include advancement cards having indicia in the form of incremental distances which advance a player toward same game objective; said plurality of second playing cards are danger cards having stated dangers which impede the advancement until one of said third playing cards which includes a remedy matching the danger is drawn from said card deck.

8. The card game of claim 7 wherein said first playing cards include indicia in the form of incremental distances for advancement of the player climbing a mountain; said danger cards refer to dangerous conditions which impede and prevent the climb of said mountain; and said third playing cards include remedy cards in the form of mountain climbing gear which matches the dangerous condition and removes the danger to allow normal progress of the player through the game.

9. The card game of claim 7 including a plurality of instruction cards which are drawn and played having instructions which impede and accelerate the advancement of said player according to said playing cards; and said instruction cards including pictorial sections on one side of said instruction cards which constitute said pictorial cards and are played in response to said instructions, and said pictorial sections having a predetermined location in a completed picture which is formed in order to accomplish said game objective.

10. The game of claim 9 wherein said pictorial cards include intermediate cards having pictorial sections which fit together in said predetermined location to partially complete said picture, and said instruction cards include completion cards having final pictorial sections which fit together with said intermediate cards in a predetermined end location of said picture to complete said game objective.

11. The game of claim 10 wherein said completion cards include first completion cards having instructions which allow the completion card to be played and the game objective reached and said completion cards include second completion cards having instructions which require that the completion card cannot be played and the game objective cannot be reached.

12. A method for a card game comprising:

(a) providing a card deck of first playing cards which are drawn and played having indicia for incremental advancement of a player towards a game objective;

(b) providing a plurality of instruction cards which are drawn and played which impede and accelerate said advancement of said player, and said instruction cards having sides which include pictorial sections which fit together to form a completed picture which satisfies said game objective;

(c) drawing said playing cards until a prescribed level of advancement is reached;

(d) drawing an instruction card when said prescribed level of advancement is reached, and playing said instruction cards in accordance with said instructions;

(e) repeating steps (c) and (d) until said completed picture is formed.

13. The method of claim 12 including providing a plurality of completion cards having instructions which permit and prevent playing of said completion card, drawing a completion card when a prescribed number of said instruction cards have been played with their pictorial faces fitted together, and playing said completion card in accordance with said instructions.

14. The method of claim 13 including providing second playing cards in said card deck which prevent said advancement until a prescribed condition is satisfied, and providing third playing cards in said card deck which must be drawn to satisfy said prescribed condition and remove the effect of said second playing cards.

15. A card game comprising:

a main card deck which includes playing cards which are drawn and played having indicia for incremental advancement of a player toward a game objective;

a stack of pictorial cards having pictorial sections on one side of said cards which are played in response to said playing cards; and said pictorial sections fit together in prescribed locations to form a completed picture in order to accomplish said game objective;

said pictorial cards include a plurality of instructions on opposite sides of said pictorial sections which limit and accelerate the advancement of said player and are drawn according to reaching prescribed levels of said playing cards;

said pictorial cards include intermediate cards having pictorial sections which fit together at said predetermined locations to partially complete said picture;

said instruction cards include completion cards having final pictorial sections which fit together with said intermediate cards at a predetermined end location to complete said game objective; and said completion cards include first completion cards having instructions which allow the completion card to be played and the game objective reached and said completion cards include second completion cards having instructions which require that the completion card cannot be played and the game objective cannot be reached.

* * * * *